US005129377A

United States Patent [19]

Taska

[11] Patent Number: 5,129,377

[45] Date of Patent: Jul. 14, 1992

[54] FUEL SUPPLY SYSTEM FOR ENGINE

[75] Inventor: Yoshiaki Taska, Hamamatsu, Japan

[73] Assignee: Sanshin Kogyo Kabushiki Kaisha, Hamamatsu, Japan

[21] Appl. No.: 574,698

[22] Filed: Aug. 29, 1990

[30] Foreign Application Priority Data

Aug. 29, 1989 [JP] Japan ..... 1-220382

[51] Int. Cl.[5] ..... F02M 1/16

[52] U.S. Cl. ..... 123/179.11

[58] Field of Search ..... 123/180 P, 187.5 R, 123/179.11

[56] References Cited

U.S. PATENT DOCUMENTS

| | | | |
|---|---|---|---|
| 2,985,161 | 5/1961 | Seegrist | 123/180 P |
| 3,371,658 | 3/1968 | Turner | 123/187.5 R |
| 3,805,758 | 4/1974 | May | 123/187.5 R |
| 3,978,839 | 9/1976 | Du Bois et al. | 123/187.5 R |
| 3,987,775 | 10/1976 | O'Connor | 123/187.5 R |
| 4,554,896 | 11/1985 | Sougawa | 123/187.5 R |

*Primary Examiner*—Andrew M. Dolinar
*Attorney, Agent, or Firm*—Ernest A. Beutler

[57] ABSTRACT

A manually operated enrichment system for an internal combustion engine for providing fuel enrichment for cold operation in the event the automatic enrichment system for the engine is not operative.

11 Claims, 4 Drawing Sheets 29
31
32
33
34
35
36
37
23
25
26
27
28
38
46
51
52
53
54
55
56
58
63
64
65

FUEL SUPPLY SYSTEM FOR ENGINE

BACKGROUND OF THE INVENTION

This invention relates to a fuel supply system for an engine and more particularly to an emergency starting fuel supply system.

Charge forming systems for most internal combustion. engines provide some form of fuel enrichment for starting and/or for cold running. This is particularly true in conjunction with two cycle crankcase compression internal combustion engines due to the long distance that the fuel must travel from its introduction into the engine and its delivery to the combustion chambers. As is well known, the fuel air charge is normally delivered to the crankcase chambers of the engine and then must travel through the scavenge passages to the combustion chambers. Under low temperatures, the fuel condensation in this circuitous path can require considerable enrichment. Of course, this problem is also true with respect to four cycle engine and two cycle engines wherein the fuel is introduced somewhere other than the crankcase chamber.

In one form of starting or cold running enrichment system, in addition to the main fuel pump of the engine there is provided an auxiliary fuel pump and an auxiliary fuel control valve which supply fuel to the engine for these abnormal conditions. Of course, the use of such added pumps and valves considerably complicates the system and may, in sole instances, give rise to considerable problems if there is a failure. Specifically, if the additional fuel pump and/or additional fuel valve become inoperative then starting of the engine may be difficult or impossible and cold running can be irregular at best.

Although arrangements have been provided for bypassing the cold enrichment system in the event of some failure, such systems still require the supply of additional fuel for starting. These systems normally rely on the main pressure pump for the supply of additional fuel and this pump may not under all circumstances provide adequate fuel, particularly for initial priming.

It is, therefore, a principal object of this invention to provide an improved and simplified fuel supply system for cold starting or cold running of engines.

It is a further object of this invention to provide an improved, simplified and highly effective auxiliary cold starting or cold running enrichment system that will be highly effective and quite simple in its operation.

It is a further object of this invention to provide such an auxiliary enrichment mechanism which will not adversely effect the running if the engine if it is inadvertently left in position when the engine is running and the enrichment is not required.

SUMMARY OF THE INVENTION

This invention is adapted to be embodied in a cold enrichment mechanism for an internal combustion engine having a fuel reservoir, a manually operated pump for pumping fuel from the fuel reservoir and a pressure pump to which fuel is delivered from the manually operated pump. The pressure pump, in turn, delivers fuel to a charge forming device which supplies the fuel to the engine for its running. An enrichment system is provided for supplying enrichment fuel for cold operation to the engine. A cold enrichment bypass system is interposed having an inlet between the manually operated fuel pump and the pressure operated fuel pump for supplying fuel to the engine for emergency cold operation and including a control valve in the bypass line for selectively opening and closing the bypass line.

6 is a cross-sectional view taken through the check valve in the cold operation system.

Figure 7:
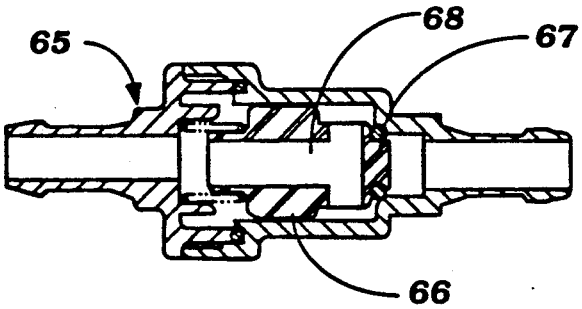

FIG. 7 is a cross-sectional view of a check valve employed in the system.

DETAILED DESCRIPTION OF THE PREFERRED EMBODIMENT OF THE INVENTION

Figure 1:
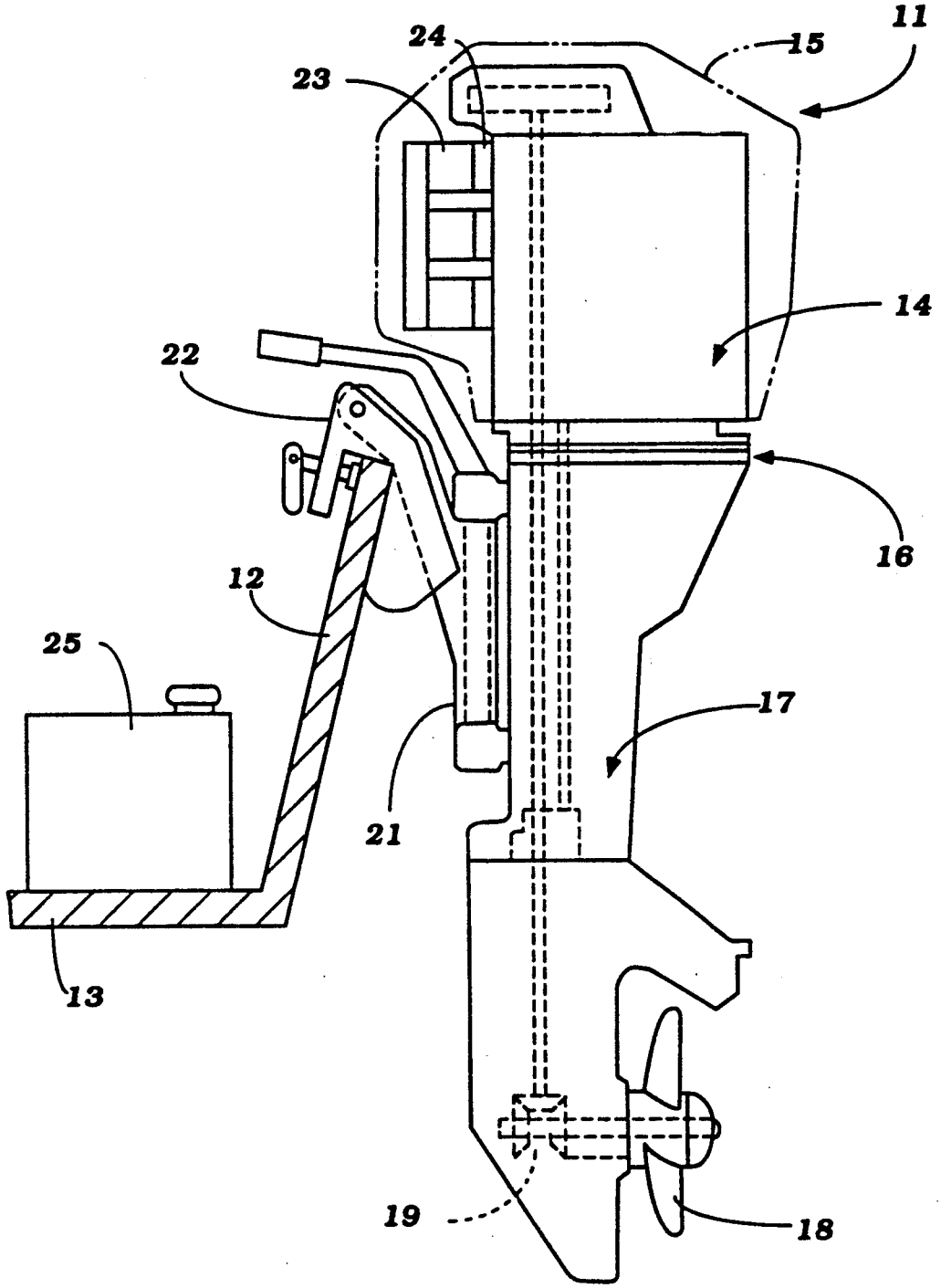
FIG. 1 is a side elevational view of an outboard motor constructed in accordance with an embodiment of the invention, with the protective cowling of the power head shown in phantom.

Referring first in detail to FIG. 1, an outboard motor constructed in accordance with an embodiment of the invention as identified generally by the references numeral 1 and is shown attached to the transom 12 of a watercraft shown partially in cross-section and identified by the reference numeral 13. Although the invention is described in conjunction with an outboard motor it is to be understood that the invention relates primarily to the enrichment system for cold operation of the engine of the outboard motor and for that reason, the described embodiment is only a typical one in which the invention may be practiced. However, the invention has particular utility in conjunction with crankcase compression two-cycle engines and such engines are conventionally employed in outboard motors. For that reason, the outboard motor application described is a preferred embodiment of the invention.

The outboard motor 11 is comprised of a power head that includes an internal combustion engine 14 and a surrounding protective cowling, shown in phantom and indicated at 15. The engine 14 is mounted on a spacer plate 16 that interconnects the power head to a drive shaft housing 17 in which a drive shaft driven by the engine output shaft is rotatably journaled. This drive shaft depends into a lower unit and dries a propeller 18 through a conventional forward neutral reverse transmission 19. A swivel bracket 21 and clamping bracket 22 of conventional construction are employed for affixing the outboard motor 11 for steering and tilt and trim movement relative to the transom 12 of the watercraft. Since the construction of the outboard motor per se forms no part of the invention, further description of it and the conventional components are not believed to be necessary so as to enable those skilled in the art to practice the invention.

The invention relates primarily to the charge forming system for the engine 14 and this charge forming system will be described additionally by primary reference to FIGS. 2 and 3 in addition to FIG. 1. In the illustrated embodiment, the engine 1S is of the V-6 type and, as aforenoted, operates on the two-cycle crankcase compression principle. As is typical with this type of engine, there are provided a plurality of carburetors 23 that provide a charge of fuel and air to the individually sealed crankcase chambers associated with each cylinder of the engine 14 through an intake manifold 24 in which reed type check valves (not shown) are provided. The fuel is supplied to the carburetors 23 and specifically the float bowls thereof, as will be hereinafter described, from a remotely positioned fuel tank 25. As is typical with outboard motor practice, the fuel tank 25 is positioned within the hull 13 of the associated watercraft and communicates with the carburetors 25 through a main supply conduit 26 in which a manually operated priming pump 27 is provided.

The priming pump 27 delivers fuel to a fuel filter 28 and then to one or more engine operated pressure pumps 29. The pumps 29 may be of any known type but in the illustrated embodiment are operated by pressure fluctuations within the individual crankcase chambers of the engine. The pumps 29 have a construction as best shown in FIG. 3 wherein a pump housing 31 is divided into a pressure chamber to which crankcase pressure is delivered through a conduit 32 and an upper pumping chamber by a diaphragm 33. An inlet fitting 34 delivers fuel to the pumping chamber through a delivery check valve 35 when the pressure in the crankcase chamber is low and the diaphragm 33 is distended as shown in the solid line view of FIG. 3. When the pressure in the crankcase chamber rises, the diaphragm will extend to the dotted line position shown in FIG. 3 and the fuel that has been drawn in through the delivery check valve 35 will be discharged through a discharge fitting 36 through a second check valve 37 which acts in opposite direction to the check valve 35. As previously noted, this type of fuel pump is well known and hence further description of it is not required.

Figures 2, 3:
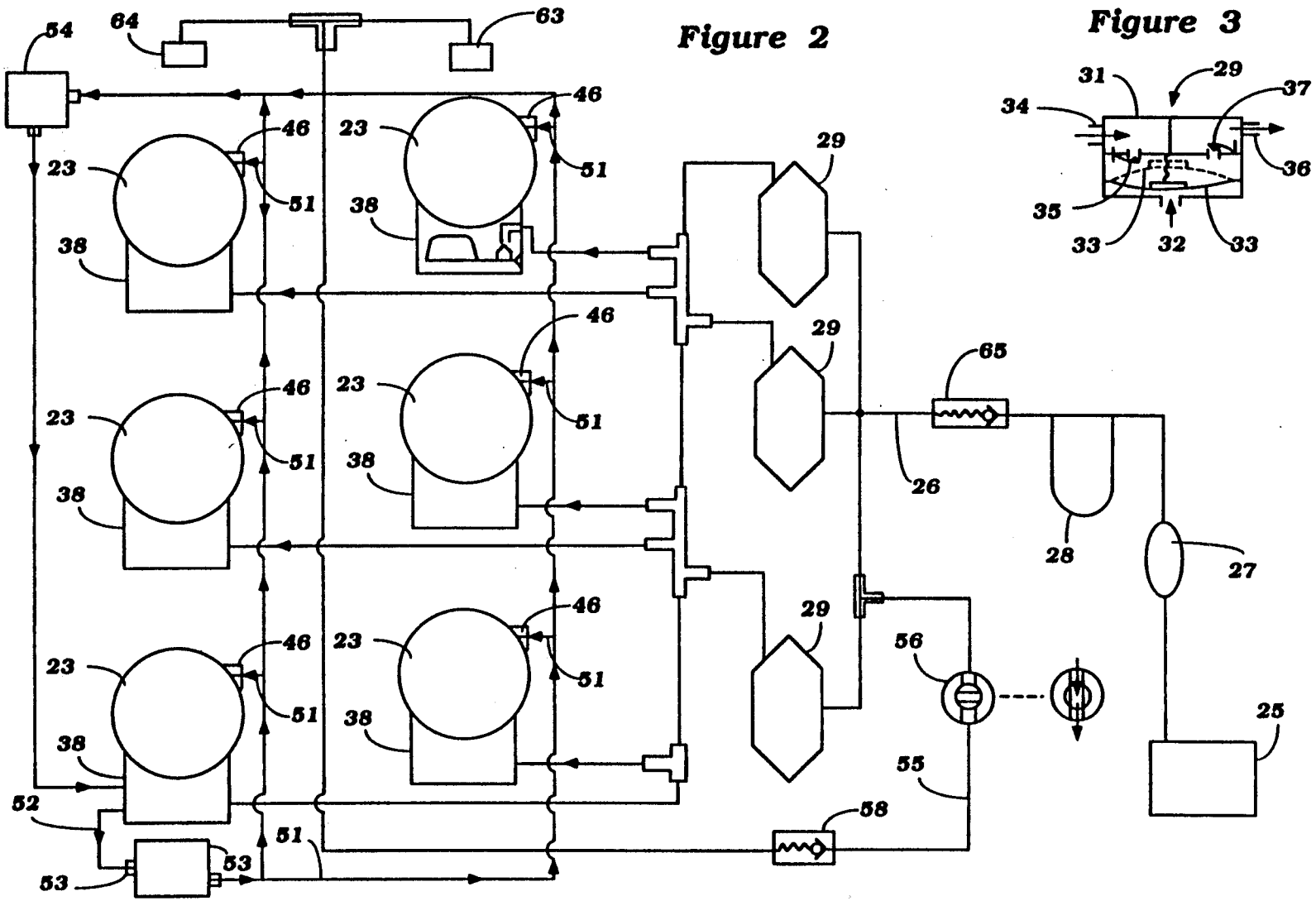
FIG. 2 is a schematic view showing the fuel supply system for the engine.
FIG. 3 is a partially schematic cross-sectional view showing one of the pressure pumps in the system and its method of operation.

The pressure pumps 29 deliver fuel to fuel bowls 38 of the carburetors 23 through a manifolding system of a known type which is shown generally schematically in FIG. 2.

Figure 4:
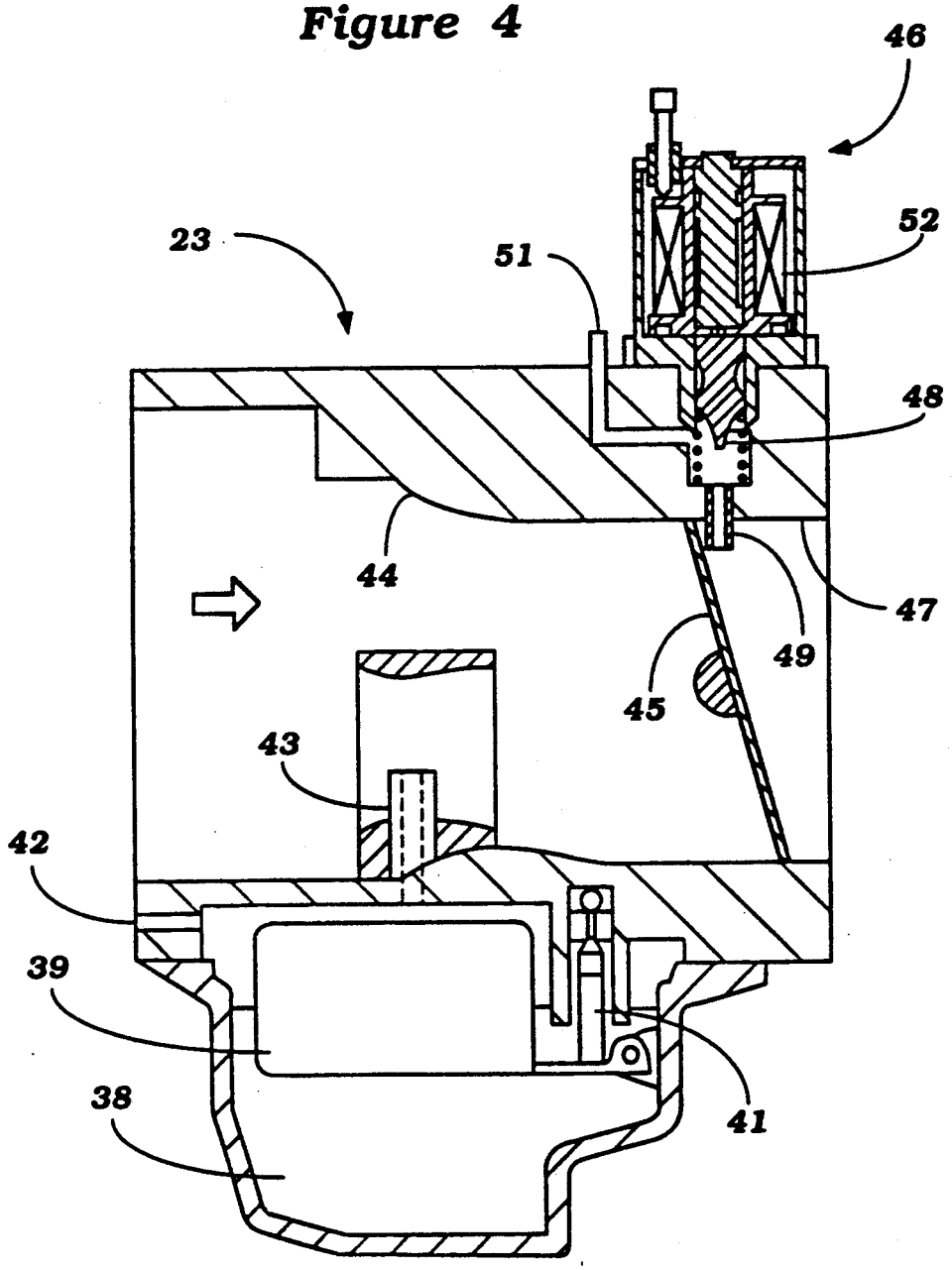
FIG. 4 is an enlarged cross-sectional view taken through one of the charge forming devices and showing the cold running enrichment system.

As may be best seen from FIG. 4, each fuel bowl 38 contains a float 39 which operates a float operated valve 41 so as to maintain uniform head of fuel in the fuel bowl 38. The fuel bowl 38 is provided with an atmospheric vent 42.

The fuel is discharged into the induction passage of the carburetors 23 through an idle fuel discharge (not shown) and a main fuel discharge system that includes a main discharge nozzle 43 that is positioned in the venturi section 44 of the carburetors 23 upstream of a speed controlling throttle valve 45. Except as hereinafter noted, the construction of the carburetors 23 may be considered conventional and, for that reason, further description of them is believed to be unnecessary.

The engine 14 is also provided with a starting enrichment system which may also supply additional fuel for cold running. The starting enrichment system, to be described, generally provides additional fuel to the engine for cranking and starting purposes, particularly at low temperatures. This system includes a plurality of enrichment devices 46 (FIGS. 2 and 4) that are mounted on each of the carburetors 23 and which when energized deliver fuel to the induction passage 47 of the carburetors 23 downstream of the throttle valves 45. These enrichment devices 46 comprise primarily solenoid operated valves 48 that control the flow of fuel into the induction passages 47 through a supplemental discharge nozzle 49 from a supplemental supply line 51. An electrical solenoid 52 cooperates with the valves 4 and effects their opening during starting and/or at low temperature.

The supplemental fuel delivered to the lines 51 is derived from at least one of the fuel bowls 38 of one of the carburetors 23 through a supply conduit 52. A supplemental fuel pump 53 is provided in this conduit and the pressure therein is maintained by a pressure regulator 54 that bypasses fuel back to the fuel bowl 38 of the carburetors 23 from which the starting fuel has been drawn.

The supplemental system operates so that the supplemental pump 53 is energized at the same time the enrichment valves 48 are opened so as to provide additional fuel. If desired, the valves 48 may be tailored so as to provide a richer amount of fuel for cranking and a reduced amount of enrichment for cold running. It is to be understood, however, the specific of cold starting and cold running enrichment and the manner in which this is accomplished is somewhat independent of the invention. The invention deals primarily with a system, now to be described, that will provide supplemental fuel for either starting or cold running in response to a failure of the automatic system as thus far described.

Figure 5:
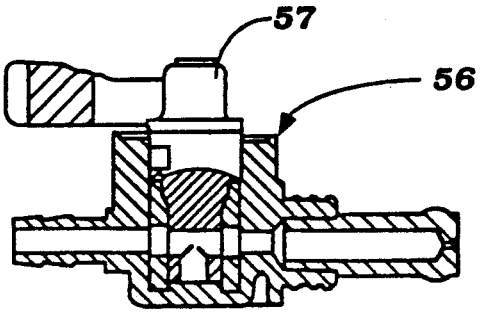
FIG. 5 is cross-sectional view through the emergency cold operation valve showing the valve in its opened position.
Figure 6:
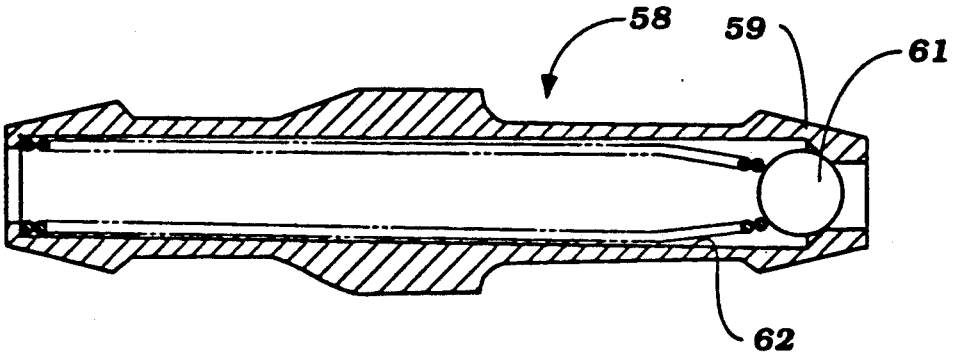

This manual enrichment system includes a bypass line 55 that is teed into the main supply line 26 between the manually operated pump 27 and the engine operated pumps 29. A manual on/off control valve 56 which may be a simple plug type of valve as shown in FIG. 5 and which has a control valve element 57 which may be rotated between a closed position and an open position as shown in the two views of Figure is provided in this line. Downstream of the manual control valve 56 there is provided a check valve 58 having a construction as best shown in FIG. 6, which has a housing 59 and a ball type check valve 61 that is urged to a closed position by a coil spring 62. In the illustrated embodiment, the manually operated enrichment fuel is supplied directly to the intake manifolds of the respective cylinder banks, indicated schematically at 63 and 64. It is to be understood, however, that this manual enrichment fuel may be supplied at any desired location in the system.

There is further provided an additional check valve 65 that is disposed in the line 26 between the manual pump 27 and the point where the line 55 is teed off. The check valve 65 as a construction as best shown in FIG. 7 and includes a slidable valve element 66 that carries a seat 67 at one end and which has an open passage 68 extending therethrough when the seat 67 is moved by the pressure of the manual pump 27 from its closed position which closed position is shown in FIG. 7.

In the event the automatic enrichment system is inoperative an operator may provide additional fuel for either starting, cold starting or cold enrichment by moving the manual valve 56 from the closed position to the open position. The manual pump 27 is then operated so as to pressurize the line 26 and deliver fuel past the check valve 65 through the conduit 55 to open the check valve 58 and provide enrichment to the manifolds 63 and 64. When the engine starts to run and if the manual valve 56 is left in its open position, there is a possibility that an air fuel mixture will be drawn back from the intake manifolds 63 and 64 through the line 55 to the inlet side of the pumps 29 by their operation. However, the check valve 58 will close under this condition and prevent the leaning of the fuel air mixture which might otherwise occur.

Also, it is important that the manual valve 56 be closed while starting the engine normally when the automatic starting system is operative otherwise additional fuel would be supplied to the manifold passages 63 and 64 which could cause fowling of the spark plugs. However, the system is basically fool proof and is effective to provide an arrangement wherein enrichment of the engine is possible even if the automatic system is inoperative so as to assist cold starting and cold running.

Of course, the foregoing description is only that of a preferred embodiment of the invention and various changes and modifications may be made without departing from the spirit and scope of the invention, as defined by the appended claims.

I claim:

1. A cold enrichment system for an internal combustion engine comprising a fuel tank, a manually operated pump for pumping fuel from said fuel tank, a pressure pump for receiving fuel from said manually operated pump and pressurizing said fuel, a charge forming device for delivering fuel to said engine from said pressure pump, an enrichment device for supplying additional fuel to said engine for cold conditions at least before the engine is running, and means for supplying fuel directly from said manual pump upstream of said pressure pump to said enrichment device through an on/off valve for effecting manual supply of fuel from said manual pump to said engine through said enrichment device for manual priming thereon without requiring any other starting operation.

2. A cold enrichment system as set forth in claim 1 further including check valve means disposed between said on/off valve and said enrichment device for permitting fuel to flow from said manually operated pump to said enrichment device but precluding flow from the enrichment device to the pressure pump.

3. A cold enrichment system as set forth in claim 2 wherein the enrichment device supplies fuel to the engine at a location other than the location where the charge forming device supplies fuel to the engine.

4. A cold enrichment system as set forth in claim 1 wherein the enrichment device supplies fuel to the engine at a location other than the location where the charge forming device supplies fuel to the engine.

5. A cold enrichment system as set forth in claim 4 wherein the enrichment device supplies fuel closer to the combustion chamber than the charge forming device.

6. A cold enrichment system as set forth in claim 5 wherein the engine is a two-cycle crankcase compression engine and the charge forming device comprises a carburetor supplying fuel to the crankcase of the engine through an induction manifold and wherein the enrichment device supplies fuel directly to the induction manifold downstream of the charge forming device.

7. A cold enrichment system as set forth in claim 1 further includes a separate enrichment pump for supplying fuel to the engine in addition to the manually operated pump.

8. A cold enrichment system as set forth in claim 7 further including check valve means disposed between said on/off valve and said enrichment device for permitting fuel to flow from said manually operated pump to said enrichment device but precluding flow from the enrichment device to the pressure pump.

9. A cold enrichment system as set forth in claim 8 wherein the enrichment device supplies fuel to the engine at a location other than the location where the charge forming device supplies fuel to the engine.

10. A cold enrichment system as set forth in claim 9 wherein the enrichment device supplies fuel closer to the combustion chamber than the charge forming device.

11. A cold enrichment system as set forth in claim 10 wherein the engine is a two-cycle crankcase compression engine and the charge forming device comprises a carburetor supplying fuel to the crankcase of the engine through an induction manifold and wherein the enrichment device supplies fuel directly to the induction manifold downstream of the charge forming device.

* * * * *